US008251005B2

(12) United States Patent
Caracostis et al.

(10) Patent No.: US 8,251,005 B2
(45) Date of Patent: Aug. 28, 2012

(54) SPAR STRUCTURES

(75) Inventors: Constantine George Caracostis, Houston, TX (US); John Joseph Kenney, Houston, TX (US); Stergios Liapis, Bellaire, TX (US); Jane Qing Zhang, Sugar Land, TX (US)

(73) Assignee: shell Oil Company, Houston, TX (US)

( * ) Notice: Subject to any disclaimer, the term of this patent is extended or adjusted under 35 U.S.C. 154(b) by 0 days.

(21) Appl. No.: 12/595,104

(22) PCT Filed: Apr. 10, 2008

(86) PCT No.: PCT/US2008/059830

§ 371 (c)(1), (2), (4) Date: Apr. 30, 2010

(87) PCT Pub. No.: WO2008/127958

PCT Pub. Date: Oct. 23, 2008

(65) Prior Publication Data

US 2011/0005443 A1 Jan. 13, 2011

Related U.S. Application Data

(60) Provisional application No. 60/911,729, filed on Apr. 13, 2007.

(51) Int. Cl.
*B63B 35/44* (2006.01)

(52) U.S. Cl. ..... 114/264; 114/243; 405/224

(58) Field of Classification Search ..... 114/264, 114/243; 405/224
See application file for complete search history.

(56) References Cited

U.S. PATENT DOCUMENTS

| | | | | |
|---|---|---|---|---|
| 6,092,483 | A | 7/2000 | Allen et al. | 114/264 |
| 6,227,137 | B1 | 5/2001 | Allen et al. | 114/264 |
| 6,263,824 | B1 | 7/2001 | Balint et al. | 114/264 |
| 6,309,141 | B1 * | 10/2001 | Cox et al. | 405/224 |
| 6,644,893 | B2 * | 11/2003 | Johnson | 405/209 |

* cited by examiner

*Primary Examiner* — Stephen Avila

(57) ABSTRACT

A spar platform comprising a deck; a buoyant tank assembly, comprising three spaced buoyant sections connected to the deck; a counterweight; and a counterweight spacing structure connecting the counterweight to the buoyant tank assembly.

18 Claims, 10 Drawing Sheets

SPAR STRUCTURES

PRIORITY CLAIM

The present application claims priority of U.S. Provisional Application No. 60/911,729 filed 13 Apr. 2007.

FIELD OF THE INVENTION

The invention relates generally to spar structures. In particular, the invention relates to spar structures optimized to reduce drag and/or vortex induced vibration.

BACKGROUND ART

Efforts to economically develop offshore oil and gas fields in ever deeper water create many unique engineering challenges. One of these challenges is providing a suitable surface accessible structure. Spars provide a promising answer for meeting these challenges. Spar designs provide a heave resistant, floating structure characterized by an elongated, vertically disposed hull. Most often this hull is cylindrical, buoyant at the top and with ballast at the base. The hull may be anchored to the ocean floor through risers, tethers, and/or mooring lines.

Though resistant to heave, spars are not immune from the rigors of the offshore environment. The typical single column profile of the hull is particularly susceptible to VIM problems in the presence of a passing current. These currents cause vortexes to shed from the sides of the hull, inducing vibrations that can hinder normal drilling and/or production operations and lead to the failure of the anchoring members or other critical structural elements.

Helical strakes and shrouds have been used or proposed for such applications to reduce vortex induced vibrations. Strakes and shrouds can theoretically be made to be effective regardless of the orientation of the current to the marine element, however, practice has shown that ineffective "bald spots" may occur in the vicinity of the strake terminations. But shrouds and strakes materially increase the drag on such large marine elements.

U.S. Pat. No. 6,227,137 discloses a spar platform having a deck supported by a buoyant tank assembly having a first buoyant section connected to the deck, a second buoyant section disposed beneath the first buoyant section; and a buoyant section spacing structure connecting the first and second buoyant sections in manner providing a horizontally extending vertical gap therebetween. A counterweight is connected to the buoyant tank assembly through a counterweight spacing structure. U.S. Pat. No. 6,227,137 is herein incorporated by reference in its entirety.

There is a need in the art for a low drag, VIM reducing system suitable for deployment in protecting the hull of a spar type offshore structure.

SUMMARY OF THE INVENTION

In one aspect, the invention relates to a spar platform comprising a deck; a buoyant tank assembly, comprising a first buoyant section connected to the deck, the first buoyant section comprises an aspect ratio from 0.001 to 1, the first buoyant section aspect ratio defined as a vertical draft of the first buoyant section divided by a diameter of the first buoyant section; a second buoyant section disposed beneath the first buoyant section, the second buoyant section comprises an aspect ratio from 0.001 to 2, the second buoyant section aspect ratio defined as a vertical height of the second buoyant section divided by a diameter of the second buoyant section; and a rigid buoyant section spacing structure connecting the first and second buoyant sections in manner providing a horizontally extending vertical gap therebetween, the gap comprises an aspect ratio from 0.15 to 2, the gap aspect ratio defined as a vertical height of the gap divided by a diameter of the first buoyant section; a counterweight; and a counterweight spacing structure connecting the counterweight to the buoyant tank assembly.

In another aspect, the invention relates to a method for reducing vortex induced vibrations in a spar platform having a deck, a substantially cylindrical buoyant tank assembly, a counterweight and an counterweight spacing structure, the method comprising reducing the aspect ratio of the spar platform by providing one or more substantially open horizontally extending vertical gaps in the buoyant tank assembly below the water line.

Advantages of the invention include one or more of the following:

A spar structure with improved VIM suppression;

A spar structure with an optimized aspect ratio configuration;

A spar structure with two or more buoyancy sections with optimized aspect ratio configurations;

A spar structure designed to disrupt the correlation of flow around the buoyancy sections;

A spar structure designed to lower the drag on the buoyancy sections; and/or

A spar structure designed to maximize current flow through one or more gaps.

Other aspects and/or advantages of the invention will be apparent from the following description and the appended claims.

DETAILED DESCRIPTION OF THE INVENTION

In one aspect, embodiments disclosed herein relate to a spar for offshore oil developments. In particular, embodiments disclosed herein relate to a spar design for reduced vortex-induced motions.

Figure 1:
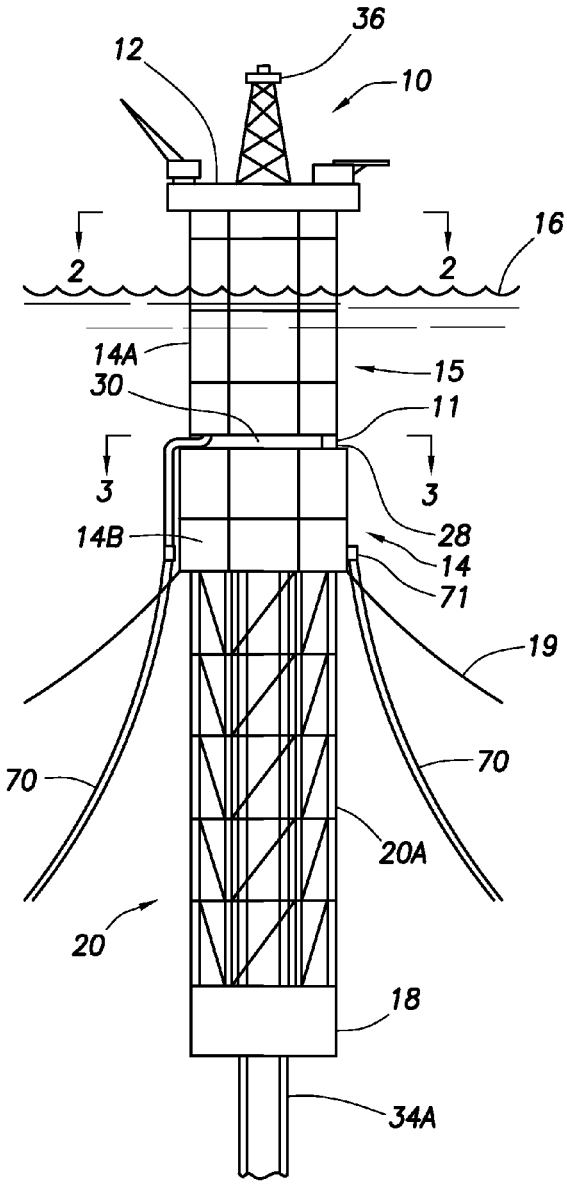
FIG. 1 is a side elevational view of one embodiment of a spar platform with spaced buoyancy in accordance with the present disclosure.

FIG. 1 illustrates a spar 10 in accordance with embodiments disclosed herein. Spars are a broad class of floating, moored offshore structure characterized in that they are resistant to heave motions and present an elongated, vertically oriented hull 14 which is buoyant at the top, shown here with buoyant tank assembly 15, and may be ballasted at its base, shown here as counterweight 18. Spars are further characterized in that the vertically oriented hull is separated from the top through a middle or counterweight spacing structure 20, such as a truss.

Spars may be deployed in a variety of sizes and configurations suited to their intended purpose ranging from drilling alone, drilling and production, or production alone. FIGS. 1-4 illustrate drilling and production spars, but those skilled in the art may readily adapt appropriate spar configurations in accordance with embodiments disclosed herein for either drilling or production operations alone as well as in other offshore activities, such as the development of offshore hydrocarbon reserves.

Figure 2:
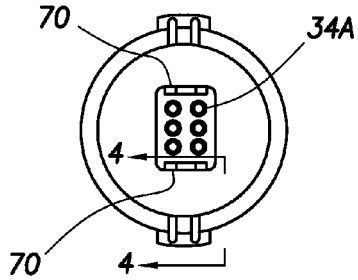
FIG. 2 is a cross sectional view of the spar platform of FIG. 1 taken at line 2-2 in FIG. 1.
Figure 3:
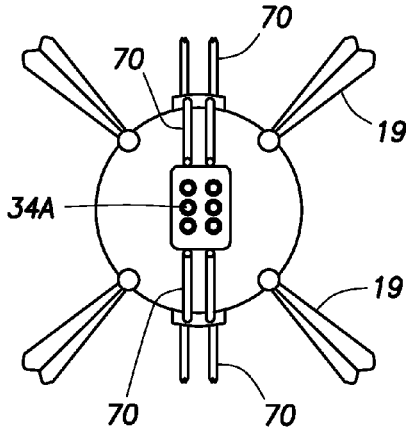
FIG. 3 is a cross sectional view of the spar platform of FIG. 1 taken at line 3-3 in FIG. 1.
Figure 4:
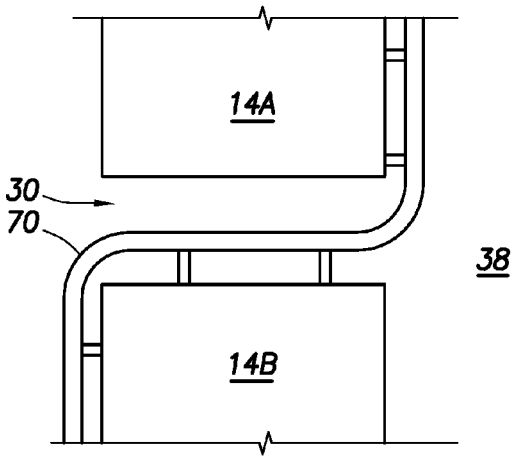
FIG. 4 is a cross sectional view of the present invention deployed in the spar platform of FIG. 1 taken at line 4-4 in FIG. 2.

In the illustrative example of FIGS. 1 and 2, spar 10 supports a deck 12 with a hull 14 having a plurality of spaced buoyancy sections, shown here having a first or upper buoyancy section 14A and a second or lower buoyancy section 14B. These buoyancy sections are separated by buoyant section spacing structure 28 to provide a substantially open, horizontally extending vertical gap 30 between adjacent buoyancy sections. In one embodiment, cylindrical hull 14 may be divided into sections having abrupt changes in diameter below the water line. Here, adjacent buoyancy sections have unequal diameters and divide the buoyant tank assembly 15 into two sections separated by a step transition 11 in a substantially horizontal plane.

In this example, a counterweight 18 is provided at the base of the spar, and the counterweight is spaced from the buoyancy sections by a counterweight spacing structure 20. Counterweight 18 may include any number of configurations, e.g., cylindrical, hexagonal, square, etc., so long as the geometry allows a connection to counterweight spacing structure 20. In the embodiment shown, the counterweight is rectangular and counterweight spacing structure 20 is provided by a substantially open truss framework 20A.

Figure 5:
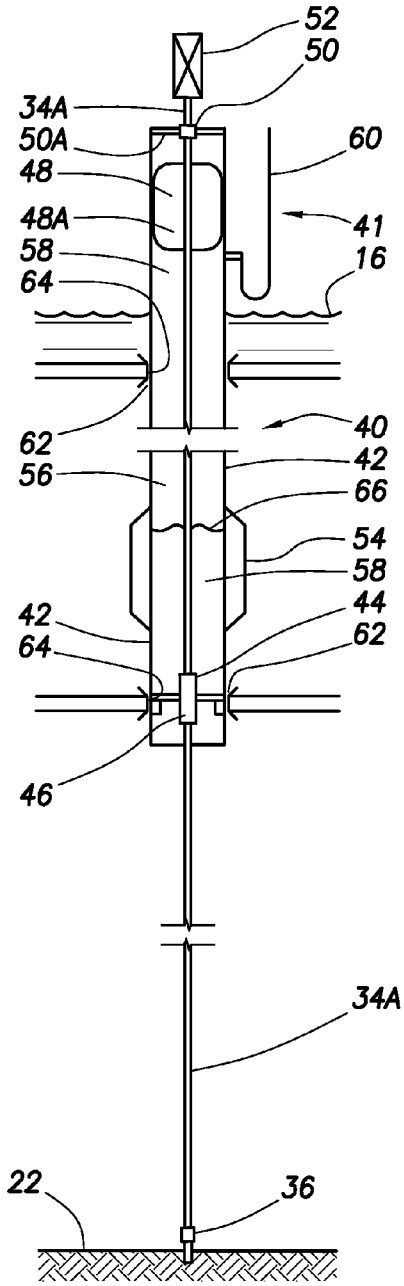
FIG. 5 is a schematically rendered cross sectional view of a riser system used with embodiments of the present disclosure.

As shown, mooring lines 19 secure the spar platform 10 over the well site at ocean floor 22 (see FIG. 5). In this embodiment, the mooring lines 19 are clustered (see FIG. 3) and provide characteristics of both taut and catenary mooring lines with buoys included in the mooring system (not shown). The mooring lines 19 terminate at their lower ends at an anchor system, such as piles secured in the seafloor (not shown). The upper end of the mooring lines 19 may extend upward through shoes, pulleys, etc. to winching facilities on deck 12 or the mooring lines 19 may be more permanently attached at their departure from hull 14 at the base of buoyant tank assembly 15 or to the counterweight 18 or to the spacing structure 20.

A basic characteristic of the spar type structure is its heave resistance. However, the typical elongated, cylindrical hull elements, whether the single caisson of a "classic" spar or the buoyant tank assembly 15 of a truss-style spar, are very susceptible to vortex induced motions ("VIM") and/or vortex induced vibration ("VIV") in the presence of a passing current. These currents cause vortexes to shed from the sides of the hull 14, inducing vibrations and/or lateral displacements/motions that may hinder normal drilling and/or production operations and lead to the failure of the risers, mooring line connections or other critical structural elements. Premature fatigue failure is a particular concern.

Prior efforts at suppressing VIV and/or VIM in spar hulls have centered on strakes and shrouds. However, both of these efforts have tended to produce structures having high drag coefficients, rendering the hull more susceptible to drift. This commits substantial increases in the robustness required in the anchoring system. Further, this is a substantial expense for structures that may have multiple elements extending from near the surface to the ocean floor and which are typically considered for water depths in excess of approximately half a mile. Typically spar structures are transported from the fabrication yard on a heavy-lift, self-propelled, dry transportation vessel. To accomplish this, the strake sections nearest the deck of the vessel, referred to as belly strakes, are left off and installed on the spar after it is floated off the transportation vessel. The float-off operation uses a quayside deep hole to provide adequate vessel draft and the belly strake installation uses significant temporary quayside moorings, construction lift equipment, and construction personnel and equipment. The spar may then be wet towed to its installation location. In some embodiments disclosed herein, the use of strakes and the additional operations described above may be avoided, which allows the spar to be transported aboard a conventionally towed jacket launch barge, and launched directly from the same vessel at the final installation site, similar to how a deepwater fixed jacket would be launched. Launching of such structures is commonplace for large jackets, but has not been performed with a spar because of the necessity of installing belly strakes quayside. In some embodiments disclosed herein, the spar may be launched directly offshore in order to save significant costs and enhance the scheduling by eliminating the quayside belly strake installation phase of the project. In some embodiments disclosed herein, the spar may be transported and/or launched from a conventional launch barge or a heavy-lift, self-propelled, dry transportation vessel and float-off operation.

Embodiments disclosed herein reduce VIM and/or VIV from currents, regardless of their angle of attack, by providing an optimal aspect ratio configuration of two or more buoyancy sections. In certain embodiments, dividing the cylindrical elements in the spar with abrupt changes in the diameter may substantially disrupt the correlation of flow about the combined cylindrical elements, thereby suppressing VIM effects on the spar hull. Further, horizontally extending, one or more vertical gaps 30 at select intervals along the length of the cylindrical hull may help reduce the drag effects of current on spar hull 14.

Production risers 34A connect wells or manifolds at the seafloor (not shown) to surface completions at deck 12 to provide a flowline for producing hydrocarbons from subsea reservoirs. Here risers 34A extend through an interior or central moonpool 38 (FIG. 4) illustrated in the cross sectional views of FIGS. 2 and 3.

Figure 6:
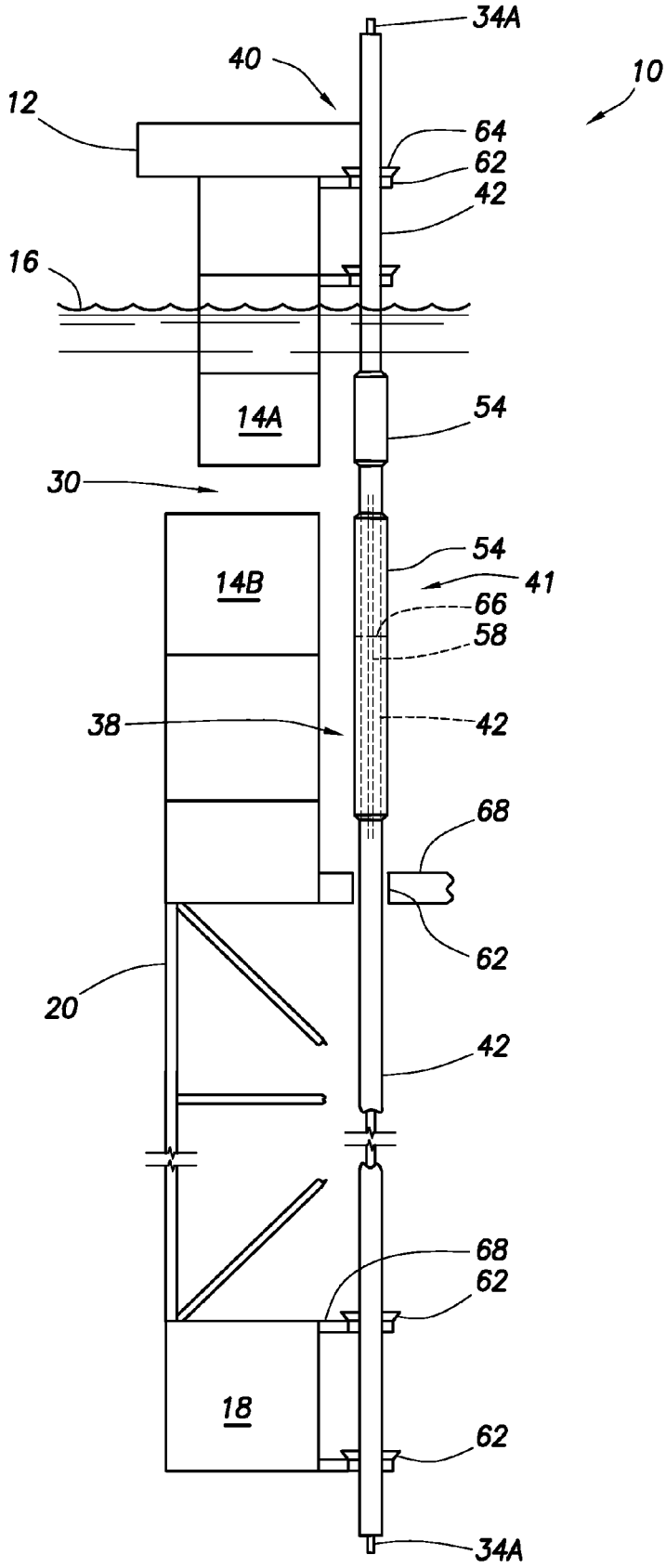
FIG. 6 is a side elevational view of a riser system deployed in an embodiment of the present disclosure.

Spar platforms characteristically resist, but do not eliminate heave and pitch motions. Further, other dynamic responses to environmental forces also contribute to relative motion between risers 34A and spar platform 10. Effective support for the risers which can accommodate this relative motion is critical, because a net compressive load can buckle the riser and collapse the pathway within the riser necessary to conduct well fluids to the surface. Similarly, excess tension from uncompensated direct support can seriously damage the riser. FIGS. 5 and 6 illustrate a deepwater riser system 40, in accordance with embodiments disclosed herein, that may support risers without the need for active, motion compensating riser tensioning systems.

FIG. 5 is a cross sectional schematic of a deepwater riser system 40 constructed in accordance with embodiments disclosed herein. Within the spar structure, production risers 34A run concentrically within buoyancy can tubes 42. One or more centralizers 44 may be used to secure this positioning. Here, centralizer 44 is secured at the lower edge of the buoyancy can tube 42 and is provided with a load transfer connection 46 in the form of an elastomeric flexjoint which takes axial load, but passes some flexure deformation. Thus, riser 34A is protected from extreme bending moments that would result from a fixed riser to spar connection at the base of spar 10. In this embodiment, the bottom of the buoyancy can tube 42 is otherwise open to the sea.

The top of the buoyancy tube can 42, however, may be provided with an upper seal 48 and a load transfer connection 50. In this embodiment, the seal and load transfer function are separated, provided by inflatable packer 48A and spider 50A, respectively. However, these functions could be combined in a hanger/gasket assembly or otherwise provided. Riser 34A extends through seal 48 and connection 50 to a Christmas tree 52, adjacent production facilities, not shown. These are connected with a flexible conduit, also not shown. In this embodiment, the upper load transfer connection assumes less axial load than lower load transfer connection 46, which takes the load of the production riser therebeneath. By contrast, the upper load connection only takes the riser load through the length of the spar, and this is only necessary to augment the riser lateral support provided the production riser by the concentric buoyancy can tube 42 surrounding the riser. Risers can also be supported with a top tensioner in addition to or instead of buoyancy cans 42.

Referring now to FIG. 6, in one embodiment, external buoyancy tanks, here provided by hard tanks 54, may be provided about the periphery of the relatively large diameter buoyancy can tube 42 to provide sufficient buoyancy to at least float an unloaded buoyancy can tube. In some applications it may be desirable for the hard tanks 54 or other form of external buoyancy tanks to provide some redundancy in overall riser support.

Additionally, load bearing buoyancy is provided to buoyancy can assembly 41 by presence of a gas 56, e.g., air or nitrogen, in the annulus 58 between buoyancy can tube 42 and riser 34A beneath seal 48. A pressure charging system 60 provides the gas and drives water out the bottom of buoyancy can tube 42 to establish the load bearing buoyant force in the riser system.

Load transfer connections 46 and 50 provide a relatively fixed support from buoyancy can assembly 41 to riser 34A. Relative motion between spar 10 and the connected riser/buoyancy assembly is accommodated at riser guide structures 62 which include wear resistant bushings within riser guide tubes 64. A wear interface is disposed between the guide tubes and the large diameter buoyancy can tubes, thereby protecting risers 34A.

FIG. 6 is a side elevational view of a deepwater riser system 40 in a partially cross-sectioned spar 10 having two buoyancy sections 14A and 14B, of unequal diameter, separated by a gap 30, in accordance with embodiments disclosed herein. A counterweight 18 is provided at the base of the spar, spaced from the buoyancy sections by a substantially open truss framework 20A.

The relatively small diameter production riser 34A runs through the relatively large diameter buoyancy can tube 42. Hard tanks 54 are attached about buoyancy can tube 42 and a gas injected into annulus 58 drives the water/gas interface 66 within buoyancy can tube 42 down buoyancy can assembly 41.

As shown, buoyancy can assembly 41 is slidingly received through a plurality of riser guides 62. The riser guide structure provides a guide tube 64 for each deepwater riser system 40, all interconnected in a structural framework connected to hull 14 of the spar. Further, in some embodiments, a significant density of structural conductor framework may be provided at such levels to tie riser guides 62 for the entire riser array to the spar hull. Further, the riser guide structure may include a plate 68 across moonpool 38.

The density of conductor framing and/or horizontal plates 68 may dampen heave of the spar. Further, an entrapped mass of water impinged by this horizontal structure is useful in otherwise tuning the dynamics of the spar, both in defining harmonics and inertia response. Yet this virtual mass is provided with minimal steel and without significantly increasing the buoyancy requirements of the spar.

Figure 7:
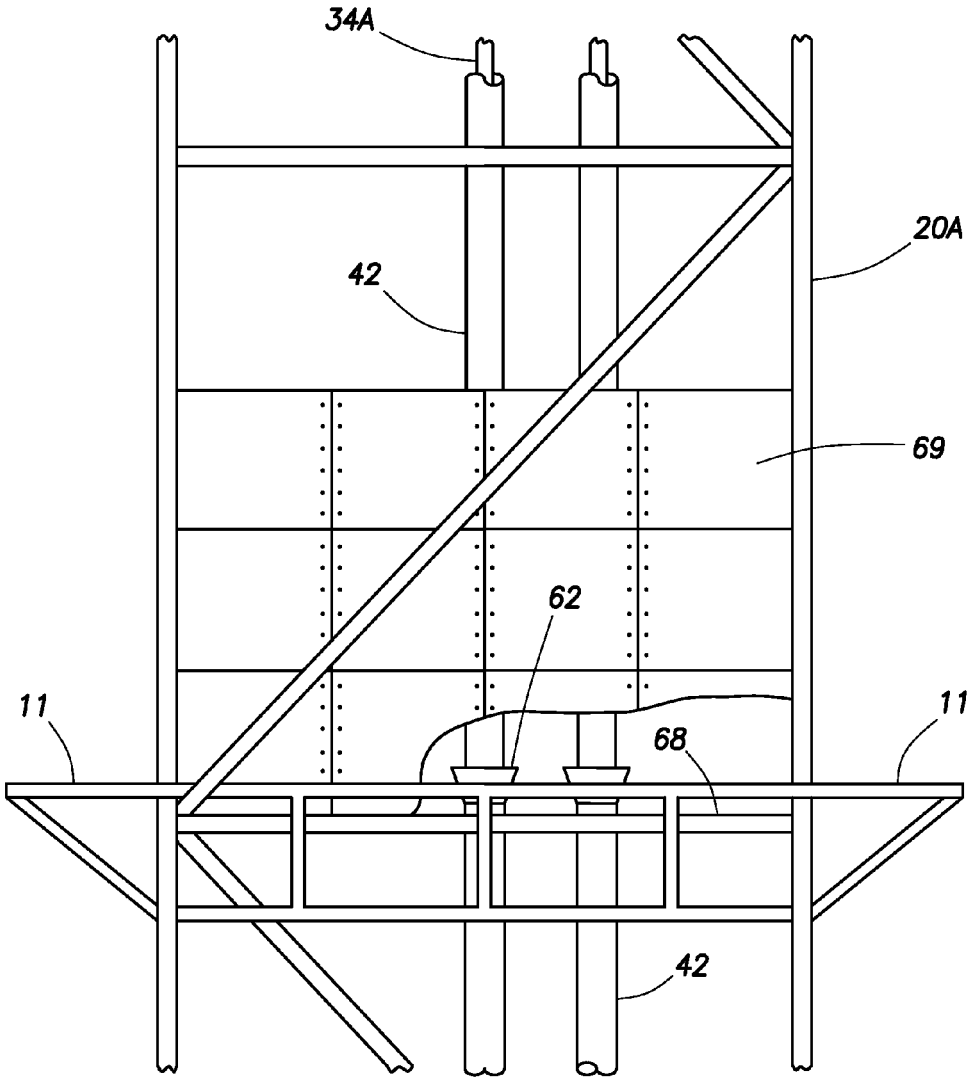
FIG. 7 is a side elevational view of a substantially open truss in an embodiment of the present disclosure.

Horizontal obstructions across the moonpool 38 of a spar with spaced buoyancy sections may also improve dynamic response by impeding the passage of dynamic wave pressures through gap 30, up moonpool 38. Other placement levels of the conductor guide framework, horizontal plates, or other horizontal impinging structure 11 (in FIG. 7) may be useful, whether across the moonpool 38, across substantially open truss 20A, as outward projections from the spar, or even as a component of the relative sizes of the upper and lower buoyancy sections, 14A and 14B, respectively. See FIG. 7.

Further, vertical impinging surfaces such as the addition of vertical plates 69 at various limited levels in open truss framework 20A may similarly enhance pitch dynamics for the spar with effective entrapped mass. Such vertical plates may, on a limited basis, close in the periphery of truss 20A, may crisscross within the truss, or be configured in another multidirectional configuration.

Returning to FIG. 6, another optional feature of this embodiment is the absence of hard tanks 54 adjacent gap 30. Gap 30 in this spar design also contributes to control of VIM and/or VIV on the cylindrical buoyancy sections 14 by dividing the aspect ratio (draft to diameter) with two or more spaced buoyancy sections 14A and 14B having similar volumes and, e.g., a separation of about 5% to 15%, for example 10% of the diameter of the upper buoyancy section. The gap advantageously reduces drag on the spar, regardless of the direction of current. Both the aspect ratio and gap design allow current to pass through the spar at the gap, thereby reducing VIM and/or VIV of the spar due to currents. Thus, reduction of the outer diameter of a plurality of deepwater riser systems at this gap may facilitate current flow through the spar gap.

Another benefit of gap 30 is that it allows passage of import and export steel catenary risers (not shown) mounted exteriorly of lower buoyancy section 14B in flexjoint receptacle (not shown). FIGS. 1-4 provide greater detail in the catenary riser system. The gap 30 provides the benefit and convenience of hanging risers exterior to the hull of the spar, but provides the protection of having the catenary riser system inside the moonpool near the water line 16 where collision damage presents the greatest risk and provides a concentration of lines that facilitates efficient processing facilities. Import and export risers 70 may be secured by standoffs and clamps above their major load connection to the spar. Below this connection, the risers drop to the seafloor with at least one catenary section in a manner, as known in the art, that accepts vertical motion at the surface more readily than the vertical access production risers 34A.

Supported by hard tanks 54 alone (without a pressure charged source of annular buoyancy), unsealed and open top buoyancy can tubes 42 may serve much like well conductors on traditional fixed platforms. Thus, the large diameter of the buoyancy can tube 42 allows passage of equipment such as a guide funnel and compact mud mat in preparation for drilling, a drilling riser with an integrated tieback connector for drilling, surface casing with a connection pod, a compact subsea tree or other valve assemblies, a compact wireline lubricator for workover operations, etc., as well as the production riser and its tieback connector. Such other tools may be conventionally supported from a derrick, gantry crane, or the like, throughout operations, as is the production riser itself during installation operations.

After production riser 34A is run (with centralizer 44 attached) and makes up with the well, a seal may be established, the annulus charged with gas, and seawater evacuated, and the load of the production riser is transferred to the buoyancy can assembly 41 as the deballasted assembly rises and load transfer connections at the top and bottom of assembly 41 engage to support riser 34A.

Referring now to FIGS. 8-11, spar designs having a predetermined aspect ratio and a horizontally extending vertical gap between at least two buoyancy sections of a hull, in accordance with embodiments disclosed herein, are shown. Embodiments disclosed herein provide a spar configuration that enhances spar stability in ocean currents by configuring the spar with at least an upper buoyancy section having a low aspect ratio. Ocean currents may thereby be forced under an upper or first buoyancy section and through a gap disposed between the first buoyancy section and a second buoyancy section. Thus, VIM and/or VIV of the spar in an ocean current may be reduced.

As described above, the aspect ratio may be defined as the ratio of draft, d, to diameter, Ø, of a buoyancy section of the hull. The term draft, as used herein, relates to the depth to which a vessel is immersed when bearing a given load. Thus, the draft may be referred to as a vertical height of immersion of a vessel. One of ordinary skill in the art will appreciate that FIGS. 8-11 are illustrative examples, and that other embodiments not shown may fall within the scope of the invention.

Figure 8A:
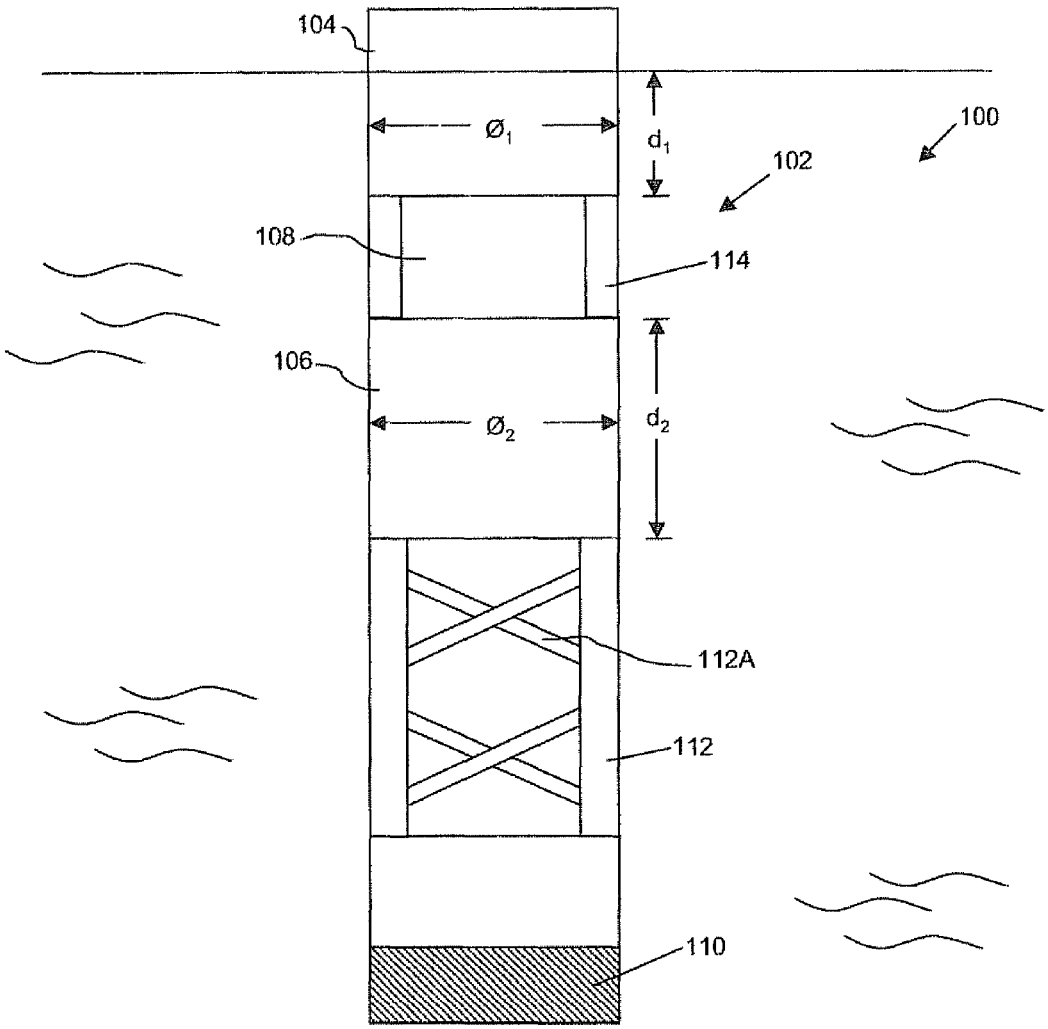
FIGS. 8A and 8B are side elevational views of a spar in accordance with embodiments of the present disclosure.

Referring now to FIG. 8A, a spar 100 includes a hull 102, including first and second buoyancy sections 104, 106, respectively, and a horizontally extending vertical gap 108 between first and second buoyancy sections 104, 106. Spar 100 is ballasted at its base with counterweight 110, that may be separated from the top through a counterweight spacing structure 112. Counterweight 110 may include any number of configurations, e.g., cylindrical, hexagonal, square, etc., so long as the geometry allows connection to counterweight spacing structure 112. In the embodiment shown, the counterweight is rectangular and counterweight spacing structure 112 is provided by a substantially open truss framework 112A.

As shown, first buoyancy section 104 is partially submerged and has a draft $d_1$ and a diameter $Ø_1$. Thus, the aspect ratio, $AR_1$, for first buoyancy section 104 may be determined as follows:

$$AR_1 = \frac{d_1}{Ø_1} \tag{1}$$

First buoyancy section 104 may have a low aspect ratio. The aspect ratio $AR_1$ of first buoyancy section 104 may be 0.5 or less, or the diameter of first buoyancy section 104 is at least two times the draft, or vertical height of immersion, of first buoyancy section 104. The aspect ratio $AR_1$ of first buoyancy section 104 may be from about 0.2 to about 0.5, for example about 0.4.

A low aspect ratio $AR_1$ of first buoyancy section 104 forces fluid, i.e., the water current, under the first buoyancy section 104 and through the horizontally extending vertical gap 108, rather than around first buoyancy section 104. Therefore, a low aspect ratio $AR_1$ of first buoyancy section 104 may provide more stability of spar 100 in water currents. Thus, a low aspect ratio $AR_1$ of first buoyancy section 104 may reduce the VIM and/or VIV of the spar due to currents. Additionally, a low aspect ration $AR_1$ of first buoyancy section 104 may reduce or eliminate the need for strakes disposed on the outer surface of first buoyancy section 104.

Still referring to FIG. 8A, second buoyancy section 106 is fully submerged and has a draft $d_2$ and a diameter $Ø_2$. Thus, the aspect ratio, $AR_2$, for second buoyancy section 106 may be determined as follows:

$$AR_2 = \frac{d_2}{Ø_2} \tag{2}$$

The aspect ratio $AR_2$ of second buoyancy section 106 may be approximately twice the aspect ratio $AR_1$ of first buoyancy section 106. The aspect ratio $AR_2$ of second buoyancy section 106 may be 1.0 or less, or the diameter of second buoyancy section may be at least the same value as the draft, or, in the instant case, where the second buoyancy section 106 is completely submerged, at least equal to the vertical height of second buoyancy section 106. The aspect ratio $AR_2$ of second buoyancy section 106 may be from about 0.4 to about 1.0, or about 0.8.

Figure 8B:
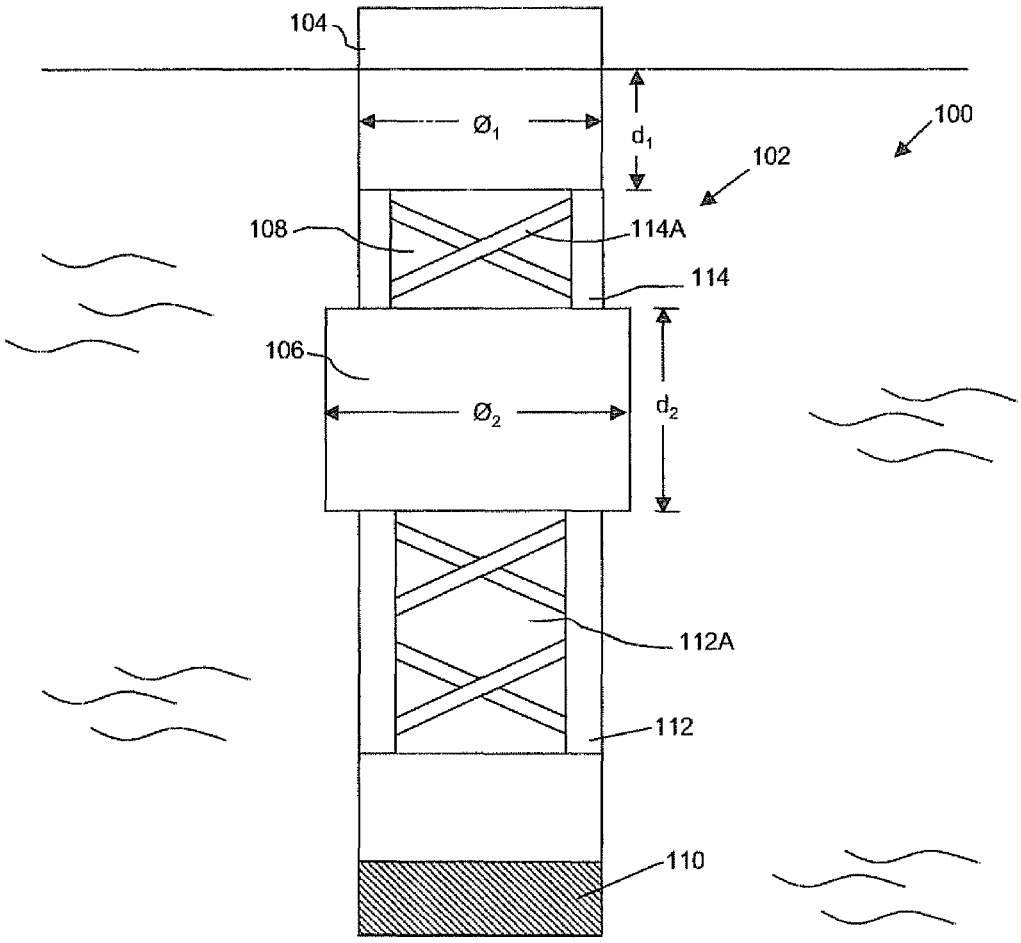

As shown in FIG. 8A, first and second buoyancy sections 104, 106 are separated by a substantially open, horizontally extending vertical gap 108. At least one buoyant section spacing structure 114 provides a connection and rigidity between first and second buoyancy sections 104, 106. In one embodiment, four buoyant section spacing structures 114 may be provided between first and second buoyancy sections 104, 106. In alternate embodiments, buoyant section spacing structures 114 may include a substantially open truss framework 114A, as shown in FIG. 8B. Buoyant section spacing structures 114 may be formed from any structural beams or other materials known in the art, such that the buoyant section spacing structures 114 withstand the weight of the buoyant sections and spar, and the force of the water current. For example, the buoyant section spacing structures 114 may include structural steel beams. One of ordinary skill in the art will appreciate that the number and shape of the buoyant section spacing structures 114 may vary without departing from the scope of embodiments disclosed herein, such that the buoyant section spacing structures 114 do not substantially impede the flow of water current through the horizontally extending vertical gap 108.

In one embodiment, the vertical height $h_g$ of horizontally extending vertical gap 108 may be determined as a function of the diameter $Ø_1$ of first buoyant section 104. For example, the vertical height $h_g$ of horizontally extending vertical gap 108 may be at least 20 percent of the diameter $Ø_1$ of first buoyant section 104, for example between about 30 and about 80 percent of the diameter $Ø_1$ of first buoyant section 104, or about 30 percent of the diameter $Ø_1$ of first buoyant section 104. Thus, if the diameter $Ø_1$ of first buoyant section 104 is equal to 30 meters, then in one embodiment, the vertical height $h_g$ of horizontally extending vertical gap 108 may be about 9 meters.

Figure 9:
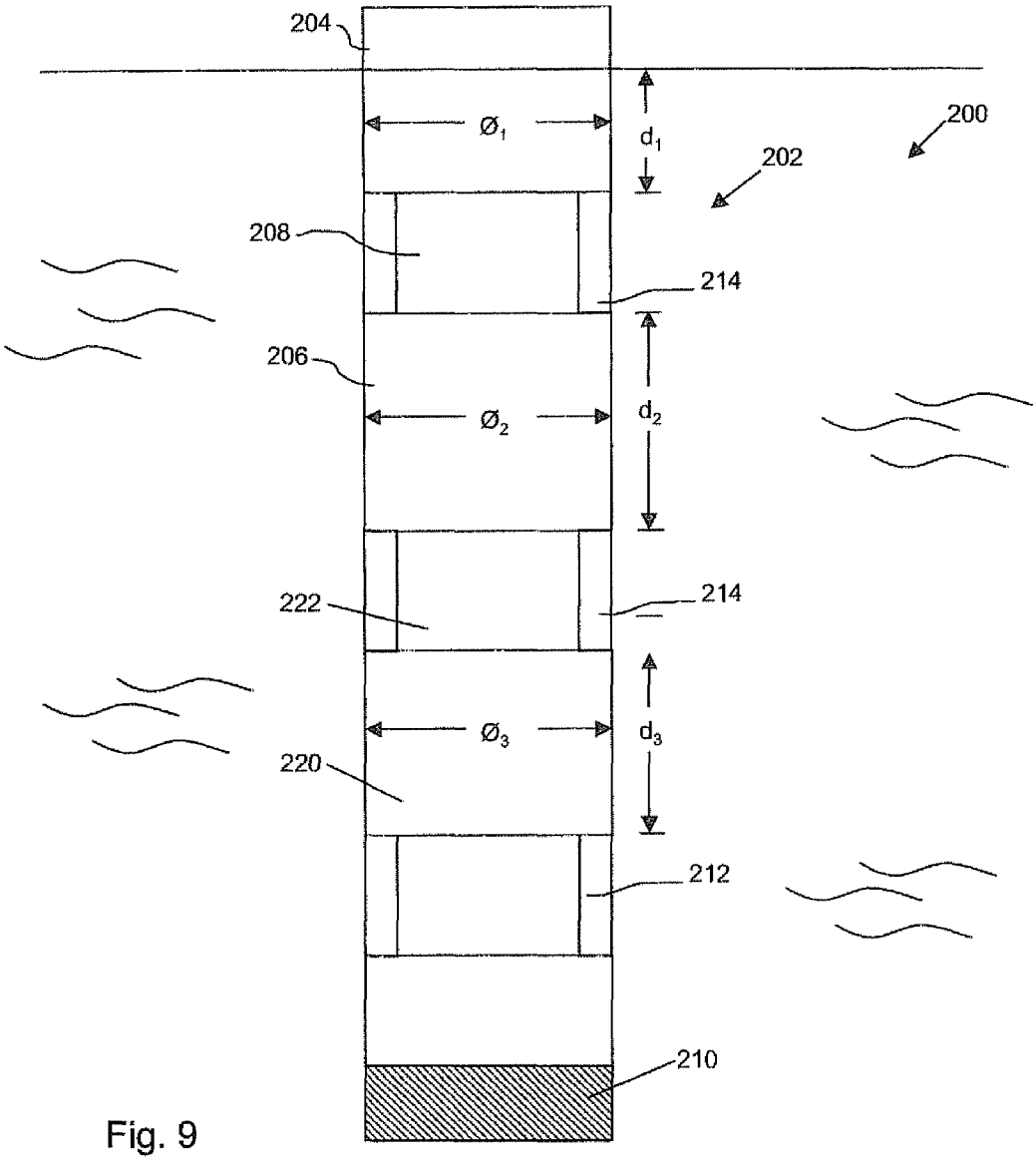
FIG. 9 is a side elevational view of a spar in accordance with embodiments of the present disclosure.

Referring now to FIG. 9, a spar 200 is shown having a hull 202, including first, second, and third sections 204, 206, 220 respectively, and horizontally extending vertical gap 208, between first and second buoyancy sections 204, 206; and vertical gap 222 between second and third sections 206, 220. Spar 200 is ballasted at its base, as illustrated by counterweight 210 that is separated from the top through a middle or counterweight spacing structure 212. As discussed above, counterweight 210 may include any number of configurations, e.g., cylindrical, hexagonal, square, etc., so long as the geometry allows connection to counterweight spacing structure 212. In the embodiment shown, the counterweight 210 is rectangular, and counterweight spacing structure 212 is provided by at least one vertical frame member. One of ordinary skill in the art will appreciate that other counterweight spacing structures 212 may be used without departing from the scope of the invention, for example a substantially open truss framework (see 112A in FIG. 8). Third section 220 may be a buoyant or non-buoyant tank, for example a tank filled with air or water.

As discussed above with reference to Equations 1 and 2, and as shown in FIG. 9, first buoyancy section 204 may have a low aspect ratio $AR_1$ and the aspect ratio $AR_2$ of second buoyancy section 206 may be approximately twice the aspect ratio $AR_1$ of first buoyancy section 206. Additionally, third section 220 has an aspect ratio $AR_3$ equal to the draft $d_3$ divided by the diameter $Ø_3$. In one embodiment, aspect ratio $AR_3$ of third section 220 may be from about 100% to about 200% of the aspect ratio $AR_2$ of second buoyancy section 206. In another embodiment, aspect ratio $AR_3$ of third section 220 may be from about 100% to about 400% of the aspect ratio $AR_1$ of first buoyancy section 204, for example about 200%. Aspect ratio $AR_3$ of third section 220 may be approximately the same as aspect ratio $AR_2$ of second buoyancy section 206. One of ordinary skill in the art will appreciate that other embodiments including more than three buoyancy sections fall within the scope of the invention. In these embodiments, subsequent buoyancy sections, i.e., lower buoyancy sections, may have an aspect ratio approximately the same or more as the aspect ratio of the preceding buoyancy section, i.e., the buoyancy section located directly above, for example from about 100% to about 200%.

Figure 10:
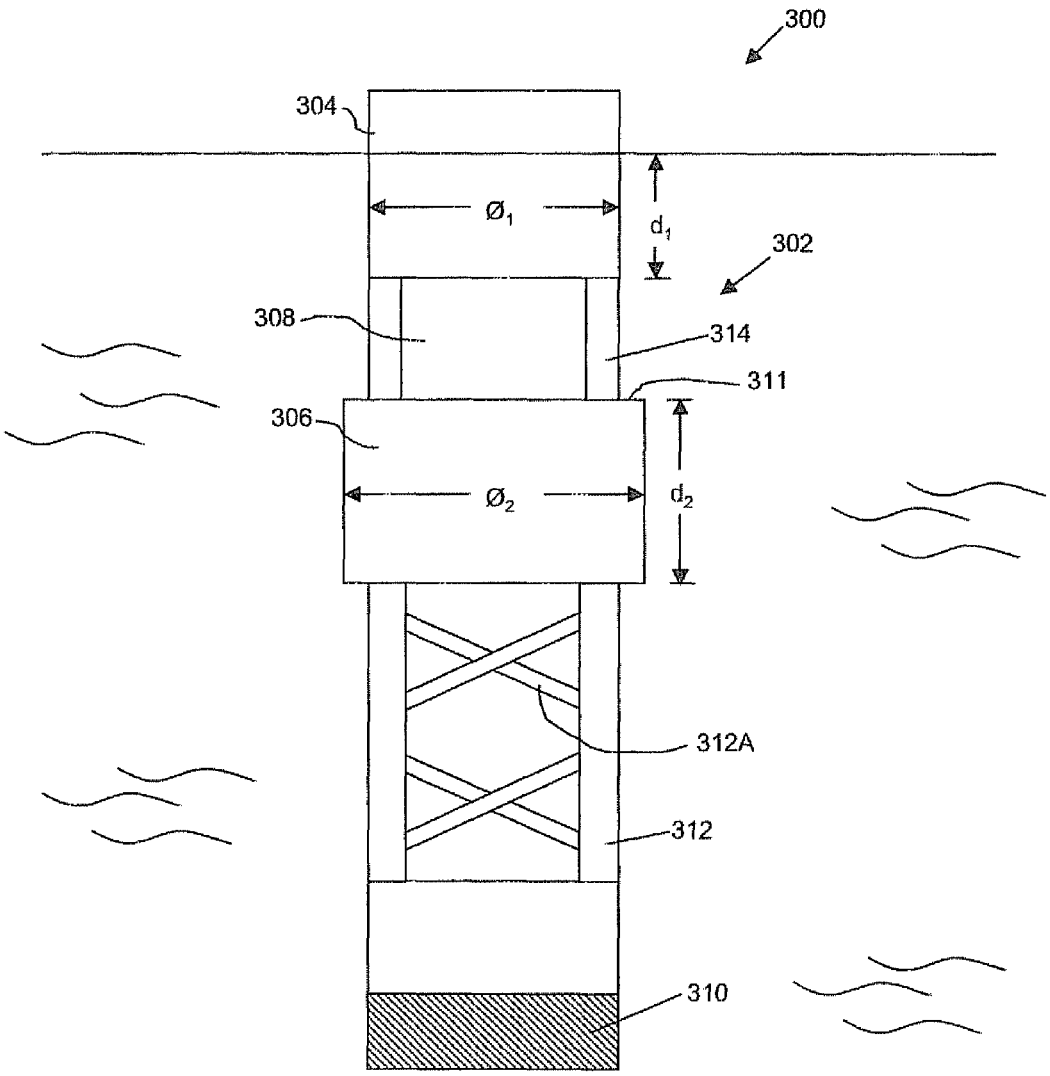
FIG. 10 is a side elevational view of a spar in accordance with embodiments of the present disclosure.

Referring now to FIG. 10, a spar 300 including first and second buoyant sections 304, 306 and a horizontally extending vertical gap 308 is shown. In this embodiment, first and second buoyant sections 304, 306 have unequal diameters. Thus, spar 300 includes a step transition 311 in a substantially horizontal plane of hull 302 between first and second buoyant sections 304, 306. One of ordinary skill in the art will appreciate that a step transition 311 may be disposed between any adjacent buoyancy sections. For example, in one embodiment, a step transition may be formed between a first and second buoyancy section 304, 306, a second and third section (not shown), or formed between both a first and second buoyancy section and a second and third section (not shown).

Figure 11:
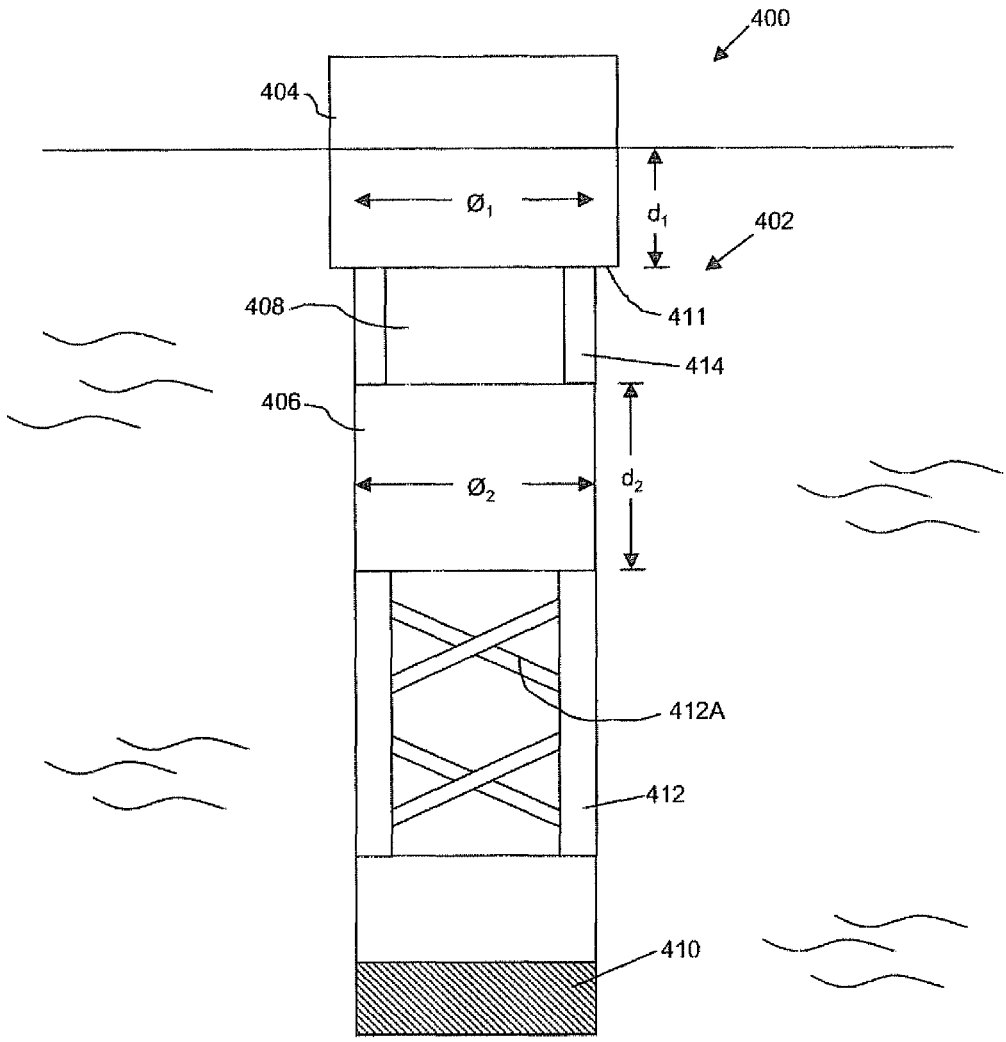
FIG. 11 is a side elevational view of a spar in accordance with embodiments of the present disclosure.

In one embodiment, as shown in FIG. 10, first buoyancy section 304 may have a diameter $Ø_1$ smaller than the diameter $Ø_2$ of the second buoyancy section 306. In other embodiments, as shown in FIG. 11, first buoyancy section 404 may have a diameter $Ø_1$ larger than the diameter $Ø_2$ of the second buoyancy section 406. Accordingly, in the embodiment shown in FIG. 11, a step transition 411 is formed in a substantially horizontal plane of hull 402 between first and second buoyant sections 404, 406. One of ordinary skill in the art will appreciate that the diameters $Ø_1$, $Ø_2$ of first and second buoyancy sections 404, 406 (304, 306 in FIG. 10) may vary, for example with the aspect ratio $AR_1$ of the first buoyancy section 404 is 0.5 or less and the aspect ratio $AR_2$ of the second buoyancy section 406 is 1.0 or less. Thus, the aspect ratio $AR_2$ of the second buoyancy section 406 may be approximately twice the aspect ratio $AR_1$ of first buoyancy section 404.

In FIG. 10, first buoyancy section 304 may have a diameter $Ø_1$ from about 50% to about 100% of the diameter $Ø_2$ of the second buoyancy section 306, for example from about 60% to about 90%, or about 70% to about 80%.

In FIG. 11, first buoyancy section 404 may have a diameter $Ø_1$ from about 100% to about 200% of the diameter $Ø_2$ of the second buoyancy section 406, for example from about 120% to about 180%, or about 130% to about 150%.

ILLUSTRATIVE EMBODIMENTS

In one embodiment, there is disclosed a spar platform comprising a deck; a buoyant tank assembly, comprising a first buoyant section connected to the deck, the first buoyant section comprises an aspect ratio from 0.001 to 1, the first buoyant section aspect ratio defined as a vertical draft of the first buoyant section divided by a diameter of the first buoyant section; a second buoyant section disposed beneath the first buoyant section, the second buoyant section comprises an aspect ratio from 0.001 to 2, the second buoyant section aspect ratio defined as a vertical height of the second buoyant section divided by a diameter of the second buoyant section; and a rigid buoyant section spacing structure connecting the first and second buoyant sections in manner providing a horizontally extending vertical gap therebetween, the gap comprises an aspect ratio from 0.15 to 2, the gap aspect ratio defined as a vertical height of the gap divided by a diameter of the first buoyant section; a counterweight; and a counterweight spacing structure connecting the counterweight to the buoyant tank assembly. In some embodiments, the spar platform also includes an anchor system. In some embodiments, the anchor system comprises a plurality of mooring lines. In some embodiments, a vertically extending open moon pool is defined through the first buoyant section. In some embodiments, the spar platform also includes one or more import risers passing to the deck through the moon pool; and one or more export risers passing to the deck through the moon pool. In some embodiments, the moon pool is further defined through the second buoyant section, the counterweight spacing structure, and the counterweight. In some embodiments, the spar platform also includes a plurality of vertically extending production risers extending upwardly through the full length of the moon pool to the deck. In some embodiments, the first and second buoyant sections are enclosed cylindrical elements and the spar platform further comprises a plurality of risers extending upwardly to the deck, externally to the first and second buoyant members. In some embodiments, the counterweight spacing structure is a cylinder. In some embodiments, the first and second buoyant sections are coaxially and vertically aligned cylindrical elements. In some embodiments, the first and second buoyant sections are of substantially equal diameters. In some embodiments, the first buoyant section comprises an aspect ratio from 0.1 to 0.75. In some embodiments, the first buoyant section comprises an aspect ratio from 0.2 to 0.5. In some embodiments, the second buoyant section comprises an aspect ratio from 0.2 to 1.5. In some embodiments, the second buoyant section comprises an aspect ratio from 0.4 to 1.0. In some embodiments, the gap comprises an aspect ratio from 0.2 to 1.0. In some embodiments, the gap comprises an aspect ratio from 0.3 to 0.8. In some embodiments, the first buoyancy section diameter is from 50% to 200% of the second buoyancy section diameter. In some embodiments, the first buoyancy section diameter is from 75% to 150% of the second buoyancy section diameter. In some embodiments, the spar platform also includes drilling facilities supported by the deck. In some embodiments, the spar platform also includes production facilities supported by the deck. In some embodiments, the counterweight spacing structure comprises a truss. In some embodiments, the spar platform also includes a third buoyant section disposed beneath the first and second buoyant sections, the third buoyant section comprises an aspect ratio from 0.001 to 2, the third buoyant section aspect ratio defined as a vertical height of the third buoyant section divided by a diameter of the third buoyant section; and a second rigid buoyant section spacing structure connecting the second and third buoyant sections in manner providing a second horizontally extending vertical gap therebetween, the second gap comprises an aspect ratio from 0.15 to 2, the gap aspect ratio defined as a vertical height of the gap divided by a diameter of the second buoyant section. In some embodiments, the third buoyant section comprises an aspect ratio from 0.2 to 1.5. In some embodiments, the third buoyant section comprises an aspect ratio from 0.4 to 1.0. In some embodiments, the second gap comprises an aspect ratio from 0.2 to 1.0. In some embodiments, the second gap comprises an aspect ratio from 0.3 to 0.8.

In one embodiment, there is disclosed a method for reducing vortex induced vibrations in a spar platform having a deck, a substantially cylindrical buoyant tank assembly, a counterweight and an counterweight spacing structure, the method comprising reducing the aspect ratio of the spar platform by providing one or more substantially open horizontally extending vertical gaps in the buoyant tank assembly below the water line. In some embodiments, the method also includes sizing the height of the gap from 15% to 200% of a diameter of the buoyant tank assembly.

EXAMPLE

Experiments were conducted to determine the VIM response of a spar located in a current, wherein the spar has one or more low aspect ratio buoyancy sections. A bare cylinder, i.e., a cylinder with no strakes, having an aspect ratio typical of a hard tank of a spar and a scaled model, constructed in accordance with embodiments described herein, were towed through water at different speeds and the response motions were measured. The results of these tests are summarized in FIG. 12, where the ratio of amplitude (A) to diameter (D) of the cylinder tested is compared to reduced velocity $V_r$, or the reduced velocity of the speed of the water current (non-dimensionalized). For example, the reduced velocity $V_r$ may be calculated as follows:

$$V_r = \text{CurrentSpeed}*\text{SwayNaturalPeriod}/\text{SparDiameter}$$

Figure 12:
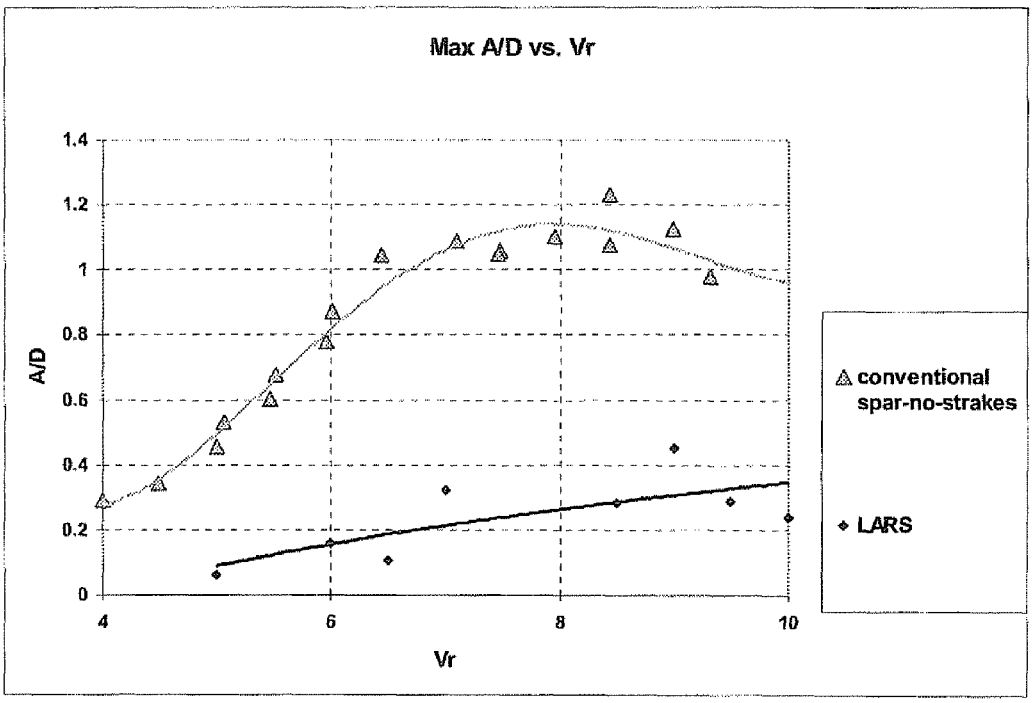
FIG. 12 is a comparison graph of vortex induced vibrations of a conventional spar and a spar in accordance with embodiments of the present disclosure.

In the experiment, the bare cylinder, with an aspect ratio typical of a hard tank of a spar, resulted in very high VIM amplitudes. As shown in FIG. 12, a conventional spar with no strakes can result in VIM amplitudes as high as 120% of the spar diameter. In contrast, a spar constructed with at least one buoyancy section having a low aspect ratio resulted in amplitudes that were generally much smaller than the conventional spar with no strakes.

Advantageously, embodiments disclosed herein provide a spar configuration that may reduce the response of the spar to ocean current. That is, embodiments disclosed herein provide a spar configuration that may reduce VIM and/or VIV of the spar due to ocean currents. Additionally, embodiments disclosed herein may provide a low aspect ratio spar configuration to enhance the performance of the spar in ocean currents. Further, in embodiments disclosed herein, the need for helical strakes may be eliminated as a result of a low aspect ratio spar configuration.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

That which is claimed is:

1. A spar platform comprising:

a deck;

a buoyant tank assembly, comprising:

a first buoyant section connected to the deck, the first buoyant section comprises an aspect ratio from 0.001 to 1, the first buoyant section aspect ratio defined as a vertical draft of the first buoyant section divided by a diameter of the first buoyant section;

a second buoyant section disposed beneath the first buoyant section, the second buoyant section comprises an aspect ratio from 0.001 to 2, the second buoyant section aspect ratio defined as a vertical height of the second buoyant section divided by a diameter of the second buoyant section; and a rigid buoyant or non-buoyant section spacing structure connecting the first and second buoyant sections in manner providing a horizontally extending vertical gap there between, the gap comprises an aspect ratio from 0.15 to 2, the gap aspect ratio defined as a vertical height of the gap divided by a diameter of the first buoyant section;

a counterweight; and a counterweight spacing structure connecting the counterweight to the buoyant tank assembly, the buoyant tank assembly further comprising:

a third buoyant or non-buoyant section disposed beneath the first and second buoyant sections, the third buoyant section comprises an aspect ratio from 0.001 to 2, the third buoyant section aspect ratio defined as a vertical height of the third buoyant section divided by a diameter of the third buoyant section; and a second rigid buoyant or non-buoyant section spacing structure connecting the second and third sections in a manner providing a second horizontally extending vertical gap there between, the second gap comprises an aspect ratio from 0.15 to 2, the gap aspect ratio defined as a vertical height of the gap divided by a diameter of the second buoyant section.

2. The spar platform of claim 1, wherein the third buoyant section comprises an aspect ratio from 0.2 to 1.5.

3. The spar platform of claim 1, wherein the third buoyant section comprises an aspect ratio from 0.4 to 1.0.

4. The spar platform of claim 1, wherein the second gap comprises an aspect ratio from 0.2 to 1.0.

5. The spar platform of claim 1, wherein the second gap comprises an aspect ratio from 0.3 to 0.8.

6. The spar platform of claim 1, further comprising an anchor system.

7. The spar platform of claim 6, wherein the anchor system comprises a plurality of mooring lines.

8. The spar platform of claim 1, wherein a vertically extending open moon pool is defined through the first buoyant section.

9. The spar platform of claim 8 further comprising: one or more import risers passing to the deck through the moon pool; and one or more export risers passing to the deck through the moon pool.

10. The spar platform of claim 8, wherein the moon pool is further defined through the second buoyant section, the counterweight spacing structure, and the counterweight.

11. The spar platform of claim 8, further comprising a plurality of vertically extending production risers extending upwardly through the full length of the moon pool to the deck.

12. The spar platform of claim 1, wherein the first and second buoyant sections are enclosed cylindrical elements and the spar platform further comprises a plurality of risers extending upwardly to the deck, externally to the first and second buoyant members.

13. The spar platform of claim 1, wherein the counterweight spacing structure is a cylinder.

14. The spar platform of claim 1, wherein the first and second buoyant sections are coaxially and vertically aligned cylindrical elements.

15. The spar platform of claim 1, wherein the first and second buoyant sections are of substantially equal diameters.

16. The spar platform of claim 1, further comprising drilling facilities supported by the deck.

17. The spar platform of claim 1, further comprising production facilities supported by the deck.

18. The spar platform of claim 1, wherein the counterweight spacing structure comprises a truss.

* * * * *